US009097132B2

(12) United States Patent
Garner

(10) Patent No.: US 9,097,132 B2
(45) Date of Patent: Aug. 4, 2015

(54) GAS TURBINE ENGINE

(75) Inventor: Stephen G. Garner, Ashby-de-la-Zouch (GB)

(73) Assignee: ROLLS-ROYCE PLC, London (GB)

( * ) Notice: Subject to any disclaimer, the term of this patent is extended or adjusted under 35 U.S.C. 154(b) by 532 days.

(21) Appl. No.: 12/585,076

(22) Filed: Sep. 2, 2009

(65) Prior Publication Data

US 2010/0129202 A1 May 27, 2010

(30) Foreign Application Priority Data

Nov. 21, 2008 (GB) ..... 0821257.3

(51) Int. Cl.

| | |
|---|---|
| ***F01D 17/02*** | (2006.01) |
| ***F01D 21/00*** | (2006.01) |
| ***G08C 23/04*** | (2006.01) |
| ***H01P 1/06*** | (2006.01) |
| ***H01P 3/12*** | (2006.01) |

(52) U.S. Cl.

CPC ..... *F01D 17/02* (2013.01); *F01D 21/003* (2013.01); *G08C 23/04* (2013.01); *H01P 1/066* (2013.01); *H01P 3/12* (2013.01); *F05D 2260/80* (2013.01)

(58) Field of Classification Search

CPC ..... F01D 17/02; F01D 21/003; G08C 23/04; H01P 1/062; H01P 1/06; H01P 1/065; H01P 1/066; H01P 3/12

USPC ..... 415/118, 216.1; 416/33, 34, 61; 333/256, 257, 261

See application file for complete search history.

(56) References Cited

U.S. PATENT DOCUMENTS

| | | | | |
|---|---|---|---|---|
| 3,155,923 | A * | 11/1964 | Persson | 333/108 |
| 4,277,789 | A | 7/1981 | Goodman, Jr. et al. | |
| 4,298,850 | A | 11/1981 | Pellerin et al. | |
| 7,083,384 | B2 * | 8/2006 | Bosselmann et al. | 416/146 R |
| 2004/0101022 | A1 | 5/2004 | Hardwicke et al. | |
| 2005/0287386 | A1 * | 12/2005 | Sabol et al. | 428/543 |
| 2009/0121896 | A1 * | 5/2009 | Mitchell et al. | 340/870.31 |

FOREIGN PATENT DOCUMENTS

| | | | |
|---|---|---|---|
| EP | 0 089 414 | A1 | 9/1983 |
| GB | 882029 | A | 11/1961 |
| GB | 2 085 662 | A | 4/1982 |
| WO | WO 2009/061467 | A2 | 5/2009 |

OTHER PUBLICATIONS

Feb. 1, 2013 Search Report issued in European Patent Application No. 09 25 2066.

* cited by examiner

*Primary Examiner* — Dwayne J White
*Assistant Examiner* — Adam W Brown
(74) *Attorney, Agent, or Firm* — Oliff PLC

(57) ABSTRACT

A gas turbine engine has a signal transmission system comprising a waveguide 40 which enables the transmission of microwave radio signals between a rotor 24 and stationary receiving electronics 32 of the engine. The waveguide 40 is centered on the engine axis 9.

7 Claims, 4 Drawing Sheets

GAS TURBINE ENGINE

This invention relates to a rotary machine having a signal transmission system for transmitting signals between relatively rotating components of the machine. The invention is particularly, although not exclusively, concerned with a machine in the form of a gas turbine engine.

It is a common requirement in a gas turbine engine for data to be transmitted between different components of the engine. Such data may, for example, comprise signals representing the operational status of a component, or control signals for controlling operation of the component. Difficulties arise if a signal has to be transmitted between two relatively rotating components. For example, it is often necessary for a signal to be transmitted between a rotor and a stationary component, or between two rotors rotating at different speeds, and possibly in different directions. Previously established practice has been to use sliding electrical contacts or a magnetic or inductive coupling, but these can be unreliable, particularly when operating in the hostile environment of a gas turbine engine. Also, such measures require electrical wiring to run from the contacts or coupling elements to associated circuit components. Such wiring can cause problems owing to environmental problems such as very high temperatures, or as a result of the physical difficulty of installing continuous wiring within the engine.

It is also known to transmit signals using radio systems broadcasting in the general radio environment. Such systems are subject to interference from outside radio sources such as radar or potentially malicious jamming systems. Such radio systems are also subject to regulatory control.

According to the present invention there is provided a gas turbine engine having an engine axis and comprising a first component which is rotatable relatively to a second component of the engine about the engine axis, and a signal transmission system which comprises a signal transmitter mounted on one of the components, a signal receiver mounted on the other of the components, and a waveguide cavity which provides signal transmission between the signal transmitter and the signal receiver, at least part of the waveguide cavity being centered on the engine axis.

At least part of the waveguide cavity may be provided in a waveguide structure which is fixed with respect to one of the components and supported rotatably, for example by means of a bearing, with respect to the other of the components. Alternatively, the waveguide cavity may be provided in a waveguide structure which comprises at least two elongate sections disposed end-to-end and centered on the engine axis, to define at least part of the waveguide cavity. The elongate sections may be rotatable relatively to each other, for example by means of a rotatable choke joint.

At least part of the waveguide cavity may be constituted by an internal cavity of a structural component of the engine, such as a shaft interconnecting a compressor stage and a turbine stage of a gas turbine engine. Alternatively, or in addition, at least part of the waveguide cavity may be constituted by the interior of a dedicated waveguide structure, by which is meant a structure provided solely as a waveguide, and which does not contribute to the normal operation of the engine.

At least part of the waveguide cavity may extend laterally of the engine axis to a transmitter or receiver disposed laterally of the engine axis. The signal transmitter and/or receiver may comprise an antenna situated in signal communication with the waveguide cavity. Thus, the transmitter/receiver (which expression embraces a transceiver) may be situated within the waveguide cavity, or adjacent an open end of the waveguide cavity.

The waveguide cavity may be a generally cylindrical cavity of circular cross-section having a longitudinal axis which coincides with the engine axis. Alternatively, the waveguide cavity may be an annular cavity extending around an axis which is coincident with the engine axis. The annular waveguide cavity may comprise first and second annular recesses in the respective components, the recesses opening towards each other.

The first component may be a bladed rotor of the engine.

According to another aspect of the present invention, there is provided a method of transmitting signals between first and second components of a gas turbine engine, which components are rotatable relatively to each other about an engine axis, the method comprising transmitting the signals through a waveguide cavity which is centered on the engine axis.

For a better understanding of the present invention, and to show more clearly how it may be carried into effect, reference will now be made, by way of example, to the accompanying drawings, in which:—

Figure 1:
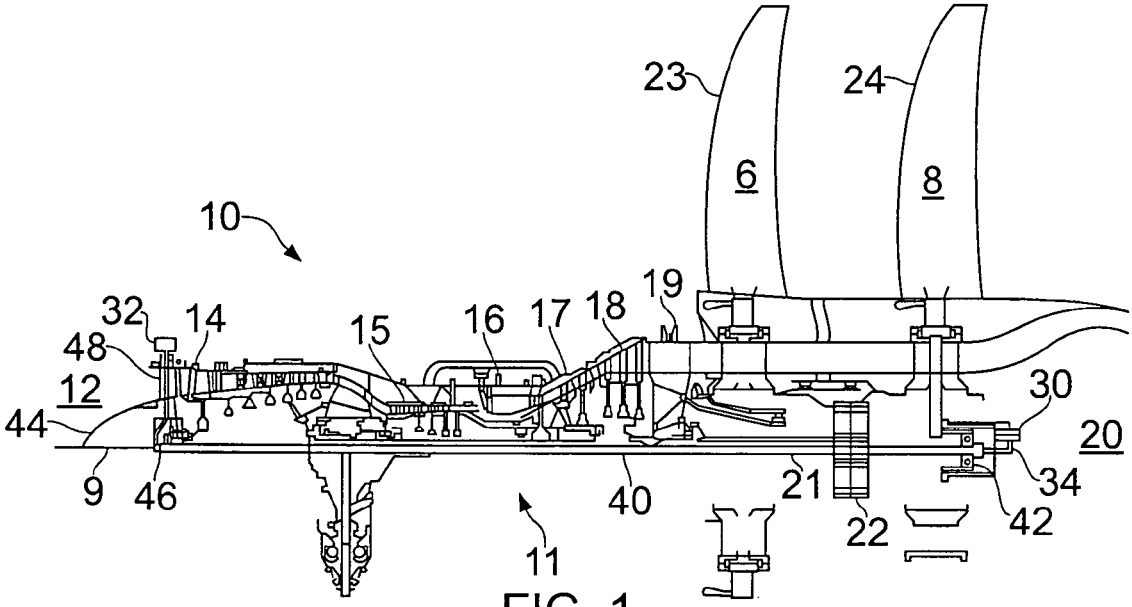
FIG. 1 is a sectional view of a gas turbine engine having a signal transmission system.
Figure 3:
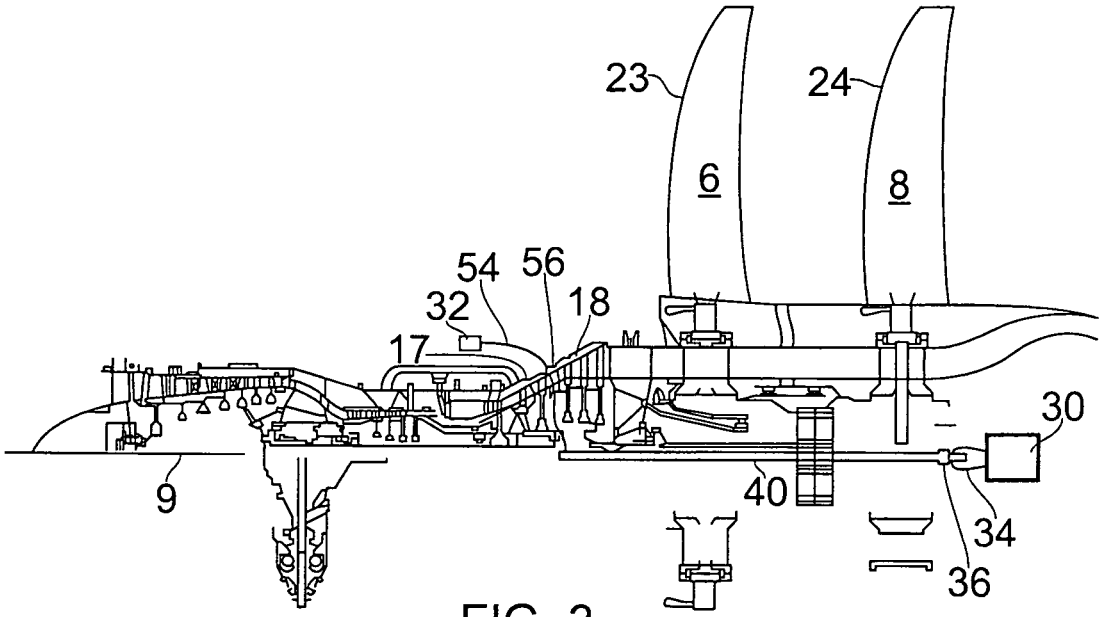
Figure 4:
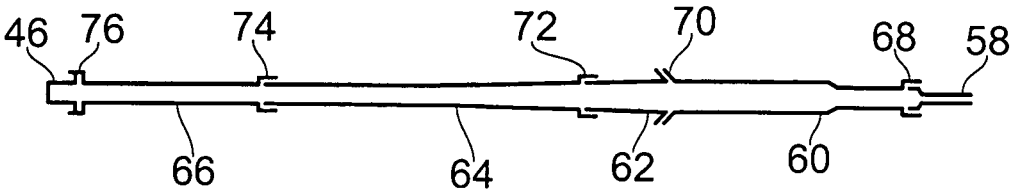
Figure 5:
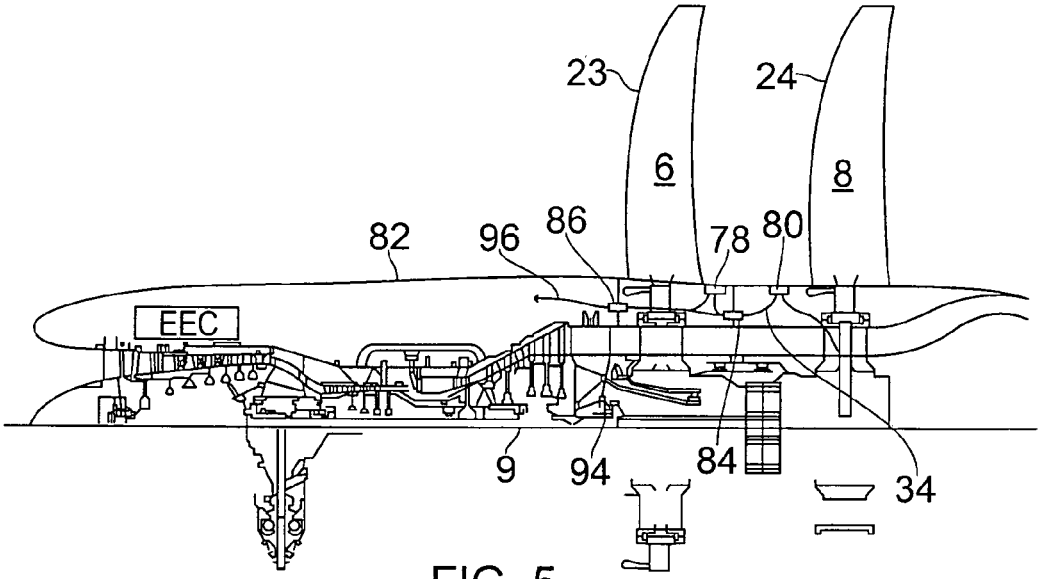
Figure 6:
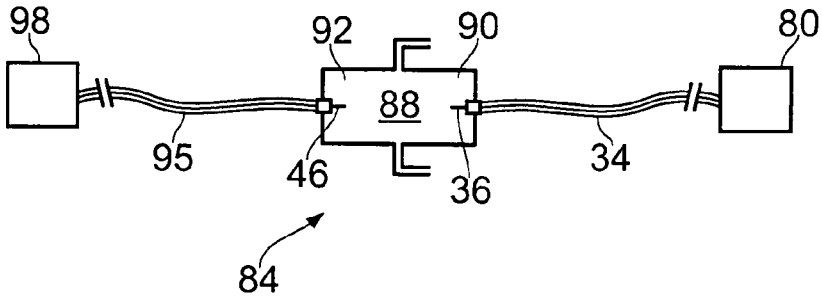
Figure 7:
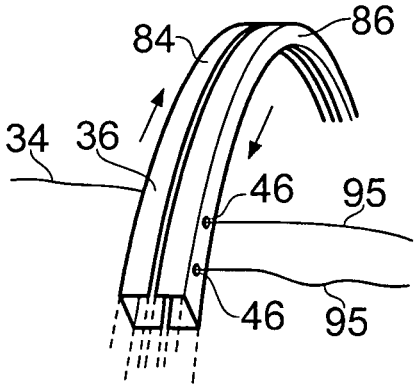
Figure 8:
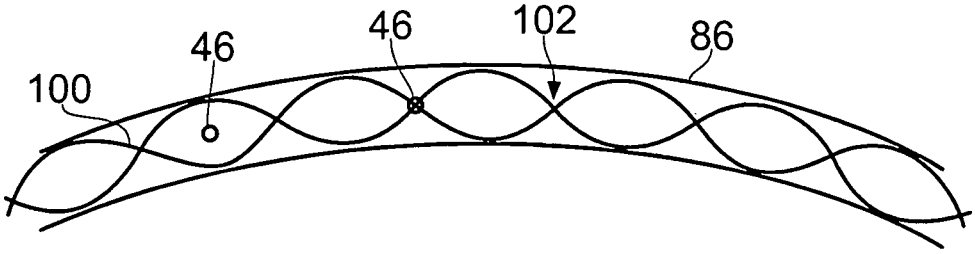

FIG. 3 corresponds to FIG. 1, but shows an alternative configuration;

FIG. 4 illustrates an embodiment of a waveguide of the signal transmission system;

FIG. 5 corresponds to FIGS. 1 and 3, but shows a further alternative configuration;

FIG. 6 shows part of the signal transmission system of FIG. 5;

FIG. 7 is a perspective partial view of an annular waveguide configuration; and FIG. 8 is a schematic partial view of the wave pattern in the annular waveguide of FIG. 7.

Referring to FIG. 1, a twin-spooled, contra-rotating propeller gas turbine engine is generally indicated at 10 and has a principal rotational axis 9. The engine 10 comprises a core engine 11 having, in axial flow series, an air intake 12, an intermediate pressure compressor 14, a high-pressure compressor 15, combustion equipment 16, a high-pressure turbine 17, an intermediate pressure turbine 18, a free power (or low-pressure) turbine 19 and a core exhaust duct 20. The engine 10 also comprises two contra-rotating propeller stages 23, 24 attached to and driven by the free power turbine 19 via a shaft 21 and a differential gear box 22.

The gas turbine engine 10 works in a conventional manner so that air entering the intake 12 is accelerated and compressed by the intermediate pressure compressor 14 and directed into the high-pressure compressor 15 where further compression takes place. The compressed air exhausted from the high-pressure compressor 15 is directed into the combustion equipment 16 where it is mixed with fuel and the mixture combusted. The resultant hot combustion products then expand through, and thereby drive the high-pressure, intermediate pressure and free power turbines 17, 18, 19 before being exhausted through the duct 20 to provide some propulsive thrust. The high-pressure, intermediate pressure and free power turbines 17, 18, 19 respectively drive the high and intermediate pressure compressors 15, 14 and the propeller stages 23, 24 by suitable interconnecting shafts. The propeller stages 23, 24 normally provide the majority of the propulsive thrust.

Each propeller stage 23, 24 comprises a bladed rotor having displaceable components in the form of variable pitch blades 6, 8.

As shown in FIG. 1, the engine 10 incorporates a signal transmission system including transmitting electronics 30 and receiving electronics 32. The transmitting electronics 30 are mounted on the rotor 24, and consequently rotates in operation about the engine axis 9. The receiving electronics 32 are mounted on the engine casing, and consequently does not rotate in operation of the engine. By way of example, the transmitting electronics 30 may receive data relating to the pitch angle of the blades 8 of the rotor 24, which must be transmitted to the receiving electronics 32 for onward transmission to a microprocessor for controlling and monitoring blade pitch.

Figure 2:
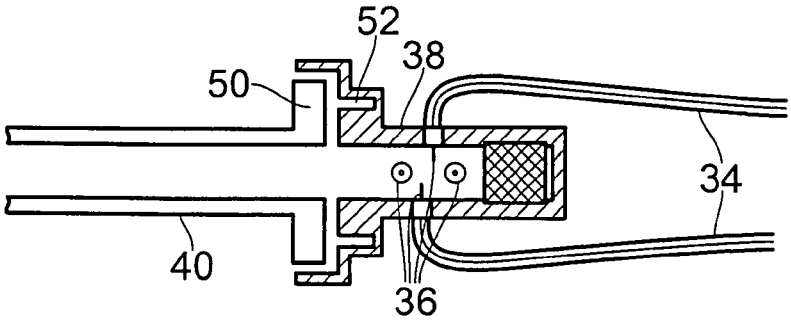
FIG. 2 shows part of the signal transmission system.

The transmitting electronics 30 supply signals along shielded wiring 34 to antennae 36 (FIG. 2). The antennae 36 thus emit radio signals, for example microwave radio signals. As shown in FIG. 2, there are four transmitting antennae 36, which are capable of independent transmission. The antennae are supported in a transmitter housing 38 which is situated adjacent one end of a waveguide 40 in the form of a simple metallic tube which extends from the transmitter housing 38 to a position close to the front of the engine, ie near the air intake 12. At the end adjacent the transmitter housing 38, the waveguide 40 is supported by a roller bearing 42. The waveguide 40 is secured to the engine casing for example at an intake fairing 44, the bearing 42 enabling the rotor 24 to rotate about the stationary waveguide 40.

A receiving antenna 46 is situated at the end of the waveguide 40 within the fairing 44, and is connected by shielded wiring 48 to the receiving electronics 32. The antennae 36, 46 are shown as simple short rods, but other forms of antennae, such as single loop antennae, may be used.

It will be appreciated that the transmitting and receiving electronics 30, 32, the antennae 36, 46 and the associated wiring 34, 48 are situated in relatively benign environments, and so are not exposed to extreme temperatures. Only the waveguide 40 extends through the hottest part of the engine. Provided that the waveguide is made from a material, such as a suitable metal, which can withstand the temperatures encountered, the signal transmission system is capable of operating reliably. If necessary, suitable insulation can be provided around the antennae 36, 46 and associated wiring.

The transmitter housing 38 need not directly contact the waveguide 40, which is provided with an end flange 50. However, as shown in FIG. 2, the transmitter housing 38 is connected to the flange 50 of the waveguide 40 by a rotating choke joint provided with an annular slot 52 which is positioned so as to minimize loss of signal at the joint. The waveguide cavity thus provides a propagation channel for microwave radio signals transmitted between the transmitting antenna 36 and the receiving antenna 46. The waveguide cavity provides a separate enclosed radio environment that is inherently not subject to interference from external sources, and likewise does not propagate electromagnetic interference into the general radio environment.

The general structure of the engine shown in FIG. 3 is substantially the same as that shown in FIG. 1. The signal transmission system is of a slightly different form in that the waveguide 40 is somewhat shorter, terminating at the end away from the transmitting electronics 30 at a position generally between the high and intermediate pressure turbines 17 and 18. Communication between the waveguide 40 and the receiving electronics 32 is by way of a further waveguide section 54 of rectangular section which allows the transmitted signal to propagate from the cavity of the waveguide 40 to an antenna (not shown) at the receiving electronics 32.

The rectangular waveguide section 54 can have a waveguide cavity of relatively small cross-sectional area compared with that of the circular cross-section waveguide 40, and may be sufficiently small to pass through a stator vane 56 in the turbines 17, 18. Also, the waveguide sections 54 can be made from a sufficiently high-temperature material to withstand the temperatures encountered in the turbines 17, 18. Consequently, the system is tolerant of the high temperatures prevailing in the engine.

FIG. 4 illustrates an embodiment in which the waveguide 40, either in the embodiment of FIG. 1 or the embodiment of FIG. 3, is made up of a plurality of waveguide sections disposed end-to-end on the axis 9 of the engine. In the example shown in FIG. 4, the waveguide 40 is made up of five sections 58, 60, 62, 64 and 66, interconnected by rotating choke joints 68, 70, 72 and 74. The receiving antenna 46 is disposed in a receiving housing 78, coupled to the waveguide 40 by a further rotating choke joint 76.

It will be appreciated that some of the waveguide sections 58, 60, 62, 64 and 66 may rotate during operation of the engine, and some, for example the waveguide section 62, may be static. The rotating waveguide sections may rotate at different speeds from one another. Furthermore, while some of the waveguide sections may be dedicated components constructed solely for the purpose of propagating signals between the transmitting antenna 36 and the receiving antennae 46, others may be constituted by functional components of the engine 10, for example shafts interconnecting compressor and turbine stages.

The embodiment shown in FIGS. 5 and 6 illustrate a further form of waveguide. In this embodiment, transmission electronics 78, 80 are mounted respectively on the rotors 23, 24. Signals are transmitted between the rotors 23 and 24 and between the rotor 23 and nacelle 82 of the engine by means of waveguides 84, 86. The waveguides 84, 86 are of annular form, extending around the engine axis 9.

As shown in FIG. 6, each waveguide 84, 86 comprises a waveguide cavity 88 made up of a first recess 90 in an axial end face of the rotor 24, and a second recess 92 in an oppositely facing axial end face of the rotor 23. The opposite faces of the rotors 23, 24 are profiled in the region of the recesses 90, 92 to form a choke-type joint 94 of generally similar form to that shown in FIG. 2.

The transmitter antenna and receiving antenna 36, 46 are disposed at opposite axial ends of the annular waveguide cavity 88. The transmitting antenna 36 is connected by wiring 34, corresponding to the wiring 34 of FIG. 2, to the transmitting electronics 80 of the rotor 24. The receiving antenna 46 is connected by wiring 95, via the other waveguide 86 and onward wiring 96, to receiving electronics 98.

It will be appreciated from FIG. 5 that the receiving antenna 46 is connected not only to the receiving electronics by the wiring 94, but also by additional wiring to the transmitting electronics 78 on the rotor 23. The transmitting electronics 78 also transmit signals along the wiring 95 to the forward waveguide 86 and thence to the receiving electronics 98 through the wiring 96.

It will thus be appreciated that, in the embodiment of FIG. 5, the waveguides 84, 86 provide annular waveguide cavities that enable the transmission of signals between the contra-rotating rotors 23, 24 and between the rotor 23 and the static engine casing 82.

The annular waveguides 84, 86 can be seen more clearly in FIG. 7, where the arrows indicate the relative rotation of the waveguides 84, 86. A standing wave 100 (FIG. 8) is generated in the waveguide 84. If a single receiving antenna 46 is used, there will be times when the signal intensity is at a minima 102, which may cause disruption of the communications. By use of a pair of receiving antennae 46 suitably spaced, it can be ensured that at least one of the antennae 46 is experiencing good signal intensity at any time so that continuous communication is maintained. Where bi-direction communication is required, each antenna 36, 46 transmits and receives. There must therefore be two antennae 36, 46 in each waveguide 84, 86 to secure the communication during receiving mode.

The present invention provides a means for contactless transmission of signals between components of a gas turbine engine which rotate relatively to each other. While the invention has been described with particular reference to the transmission of signals in the form of microwave radio signals, it will be appreciated that other types of signal carrier could be used.

In all embodiments described above, the waveguide cavities can be used to provide high bandwidth multi-channel bi-directional independent communication. Thus the transmitting and receiving components referred to above can be replaced respectively by receiving and transmitting components, or by transceivers.

Although the invention has been described with specific reference to signal transmission systems in gas turbine engines, the invention is also applicable to other rotary machines in which signals are to be transmitted between a rotating component and a stationary structure or another rotating component rotating at a different speed or in a different direction. Such rotary machines may, for example, be machines in which the rotating component performs work on or extracts work from a flow of fluid past the component, or machines such as motors or generators in which rotation of the rotating component generates or absorbs electrical power.

The invention claimed is:

1. A gas turbine engine comprising:

an engine axis;

a first component and a second component, wherein the first component is rotatable relative to the second component about the engine axis; and a signal transmission system including a signal transmitter mounted on one of the components, a signal receiver mounted on the other of the components, and a waveguide cavity: i) that forms a separate enclosed environment provided by a propagation channel that constrains therein signal transmission between the signal transmitter and the signal receiver, ii) at least part of which is centered on the engine axis, and iii) that is annular about the engine axis, wherein the waveguide cavity is formed of at least two elongate sections disposed end to end, the elongate sections, or at least two of the elongate sections, being rotatable relatively to each other the engine axis; and at least one rotating choke coupled to the waveguide cavity, wherein the rotating choke is a rotatable choke joint, and the relatively rotatable elongate sections are coupled to each other at the rotatable choke joint.

2. The gas turbine engine of claim 1, wherein at least part of the waveguide cavity is provided in a waveguide structure which is fixed with respect to one of the components and is rotatable relatively to the other component.

3. The gas turbine engine of claim 1, wherein at least part of the waveguide cavity is provided in a waveguide structure which comprises the at least two elongate sections disposed end to end and centered on the engine axis.

4. The gas turbine engine of claim 1, wherein the waveguide cavity includes a section which extends laterally of the engine axis to the transmitter or the receiver disposed laterally of the engine axis.

5. The gas turbine engine of claim 1, wherein the waveguide cavity comprises a first annular recess in the first component and a second annular recess in the second component.

6. The gas turbine engine of claim 1, wherein at least part of the waveguide cavity is constituted by an internal cavity of a structural component of the engine.

7. The gas turbine engine of claim 1, wherein the separate enclosed environment is a separate enclosed radio environment and the waveguide cavity provides the separate enclosed radio environment that is inherently not subject to interference from external sources, and does not propagate electromagnetic interference into a general radio environment.

* * * * *